US008151709B1

(12) United States Patent
Schwartz et al.

(10) Patent No.: US 8,151,709 B1
(45) Date of Patent: Apr. 10, 2012

(54) ANTI-SETBACK SPIN CLIP APPLICATION

(75) Inventors: Barry Schwartz, Newton, NJ (US); John T. Geaney, Lafayette, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 35 days.

(21) Appl. No.: 12/771,045

(22) Filed: Apr. 30, 2010

(51) Int. Cl.
*F42C 1/06* (2006.01)
*F42C 15/22* (2006.01)

(52) U.S. Cl. ..... 102/273; 102/239

(58) Field of Classification Search ..... 102/237, 102/239, 241, 243, 272, 273, 499, 500
See application file for complete search history.

(56) References Cited

U.S. PATENT DOCUMENTS 2,137,983 A * 11/1938 Remondy ..... 102/275
3,956,992 A * 5/1976 Tari ..... 102/244
4,013,013 A * 3/1977 Davis ..... 102/275
4,466,351 A * 8/1984 Strobush ..... 102/275
5,243,912 A * 9/1993 Ziemba ..... 102/235
7,357,081 B2 * 4/2008 Zinell et al. ..... 102/245
* cited by examiner

*Primary Examiner* — James Bergin
(74) *Attorney, Agent, or Firm* — Henry S. Goldfine

(57) ABSTRACT

A stab type fuze mechanism, such as the 30 mm M759 fuze mechanism, which utilizes a generally horse shoe shaped configuration anti-setback spin clip initially lodged in a grove within the body of a target sensing probe, but extending partially therefrom, which extending part rests against a ledge within the aluminum o-give—located rearward from the target sensing probe; thereby preventing the target sensing probe from moving rearward within the fuze during firing and setback. After firing, with the onset of spin, the anti-setback spin clip will open, expanding away from, out of, and clear of the grove and into a cylindrical channel in which the target sensing probe is lodged. Due to a thinned area at the apex of the clip, the expansion of the anti-setback spin clip will be a plastic deformation and the clip will remain expanded. With the expanded clip entirely clear of the grove—when the cartridge impacts its target, either a hard target, or a soft target, the obstructed forward travel of the cartridge will force the target sensing probe rearwards to impact the firing pin located immediately rearward thereof; thereby, forcing the firing pin rearward and initiating the firing train of the fuze, and subsequently, igniting the secondary explosive within the cartridge to cause detonate thereof.

6 Claims, 3 Drawing Sheets

ANTI-SETBACK SPIN CLIP APPLICATION

FEDERAL RESEARCH STATEMENT

The inventions described herein may be manufactured, used and licensed by, or for, the U.S. Government, for U.S. Government purposes.

BACKGROUND OF INVENTION

1. Field of the Invention

The present invention relates to an improved fuze initiation device to allow faster warhead detonation, and more particularly, to such a device for use in the M759 or similar stab upon impact type fuzes.

2. Background Art

The AH-64 Apache is a four-blade, twin-engine attack helicopter with a tandem cockpit for a crew of two, whose mission involves close air support to fulfill that mission; regarding which mission; the Apache is provided with an M230 chain gun with 1,200 rounds of 30 mm ammunition. The M230 Chain Gun is a single-barrel electrically operated, automatic cannon that was developed by Hughes and is currently manufactured by Alliant Techsystems. The M230 is a formidable weapon that is electrically primed, has a chamber pressure measured at 40,600 to 44,950 psi, and a muzzle velocity of 2,640 feet per second for both target practice (TP) and high-explosive dual purpose (HEDP) type ammunition. The "dual purpose" of the HEDP ammunition is its design for both anti-materiel and anti-personnel purposes. This HEDP ammunition has an aluminum cartridge, and a steel body loaded with 27 grams of PBXN-5 high explosive charge. Each HEDP round, or cartridge, or projectile, incorporates a spin compensated shaped charge liner, to help compensate for the 60,000 rpm terminal spin, and has a dual function, type M759 fuze. The fuze arms while the projectile is in flight and initiates detonation of the projectile's explosive fill upon a direct impact that causes immediate loss of velocity/momentum (i.e. dual mode action). The shaped charge liner collapses upon detonation creating an armor piercing jet with an estimated penetration performance which is in excess of 50 mm rolled homogeneous armor (RHA) at 2,500 meters. Fragmentation of the projectile body also occurs upon detonation thereby producing significant antipersonnel effects.

The current M759 fuze design incorporates as an initiation feature a generally cylindrical nylon probe with a surrounding aluminum confinement cap that moves rearward upon target impact to trigger the firing pin, i.e. point detonation (PD). This generally cylindrical nylon probe, which is located in the fuze at the nose of the 30 mm cartridge, has an integral cylindrical shoulder extending from the lower section thereof; which nylon shoulder, abuts a ledge within the aluminum o-give section of the fuze, which ledge is located toward the front of the cartridge. When the cartridge is fired, the probe is subjected to an acceleration, or setback load, of up to 100,000 g's and the subject nylon shoulder is forced, in a rearwards direction against the ledge. However, this nylon shoulder is designed to resist this setback level of force and will therefore keep the probe from moving rearward and triggering the firing pin, until the cartridge impacts a hard target and abruptly stops. Upon such a sudden stop, the force rearward imparted to the probe and its aluminum confining cup, causes the nylon shoulder to shear away against the aluminum ledge, allowing the probe to move rearwards within the fuze, thereby impacting the firing pin to initiate the detonation chain, i.e. the firing pin hits the sensitive primary explosive within the fuze (a "stabbing" type effect), which detonates and in turn ignites the secondary explosive in the body of the cartridge.

The design of the current nylon shoulder probe system is such that the nylon shoulder will not reliably shear away when the cartridge hits a soft target, such as sandy ground or plowed fields, or hits a glancing blow, where the cartridge does not immediately stop. Therefore, there is a need in the art for an initiation mechanism within the M759, or similar stab upon impact type fuzes, that will reliably allow the detonation of the cartridge upon impacting either a hard or soft target, directly or glancing. Such an initiation mechanism will afford increased lethal effect over the prior art, when utilized against soft targets in anti-personnel applications, while expending fewer cartridges.

SUMMARY OF INVENTION

The present invention relates to a simple, reliable, and relatively inexpensive initiation mechanism to initiate the detonation upon and only upon impact of M759 or similar stab upon impact type fuzes—impact that may be directly or tangentially against a hard target, or soft target. In the present invention a generally cylindrical target sensing probe, preferably manufactured of a light weight metal, is provided within a generally cylindrical channel located immediately behind the windscreen in the nose of the fuze, the target sensing probe has an annular section extending from and running along a length of its middle, which section touches and rides against the cylindrical interior of the channel to keep the target sensing probe centered as it moves within the cylindrical channel. The target sensing probe is provided with an anti-setback spin clip, which clip prior to firing is generally horse shoe shaped, with its open end forced about and lodged in a grove within and about the body of the generally cylindrical target sensing probe, but extending partially therefrom. Adjacent to the extending portion of this clip, and just rearward within the fuze therefrom, is a ledge within the aluminum o-give; which ledge extends inward toward the center line of the cartridge, so as to support the portion of the clip extending from the grove—such that during firing, and setback, this overlap will keep the clip and the target sensing probe, within which it is crimped, from moving rearward within the fuze and from impacting the firing pin. After firing, with the onset of spin, the clip will expand away from, out of, and clear of the grove within the target sensing probe and into the cylindrical channel. Due to a thinned area in the middle or apex of the horse shoe shaped clip, the expansion of the clip will be a plastic deformation and the clip once opened/expanded will remain open/expanded. The expanded clip, as stated, will be moved entirely clear of the grove within the target sensing probe, there being adequate space/clearance between the wall of the cylindrical channel and the target sensing probe—such that when the target sensing probe impacts its target, the obstructed forward travel of the target sensing probe will force it rearwards in the fuze (there being now no impediment to such a motion). The target sensing probe will impact the piston assembly, which houses the firing pin, located immediately rearward thereof within the fuze; thereby, forcing the firing pin rearward and initiating the firing train of the fuze, and subsequently, igniting the secondary explosive within the cartridge to cause detonation thereof.

The target sensing probe in the subject invention is preferably manufactured of light weight metal, preferably aluminum, or of a filled polymeric material; as, such obvious alternative materials as unfilled Lexan® (a brand of unfilled polycarbonate resin thermoplastic used in making bullet proof glass applications), or acrylonitrile butadiene styrene (ABS) (a common thermoplastic used to make light, rigid, molded products such as piping) were found inadequate under the subject setback and rotation forces. Applications experiencing lesser setback and rotation forces may allow the use of unfilled materials.

The subject metallic target sensing probe is preferably designed to be of comparable mass to that of the prior art nylon probe and confinement cup—so as to provide comparable flight stability. Therefore after significant experimentation, an aluminum metallic target sensing probe was designed, with a cylindrical boring along the longitudinal axis to reduce its mass to the desired level. The preferred aluminum probe has a front face adjacent to and open toward the windscreen at the front of the fuze and the rear face located rearward within the fuze, which second end is closed, i.e. a blind hole. Alternatively, other light weight metals, such as magnesium may suffice; however, their configuration may require tweaking to obtain the required mass.

Further features and advantages of the present invention will be set forth in, or apparent from, the detailed description of preferred embodiments thereof which follows.

DETAILED DESCRIPTION

Figure 1:
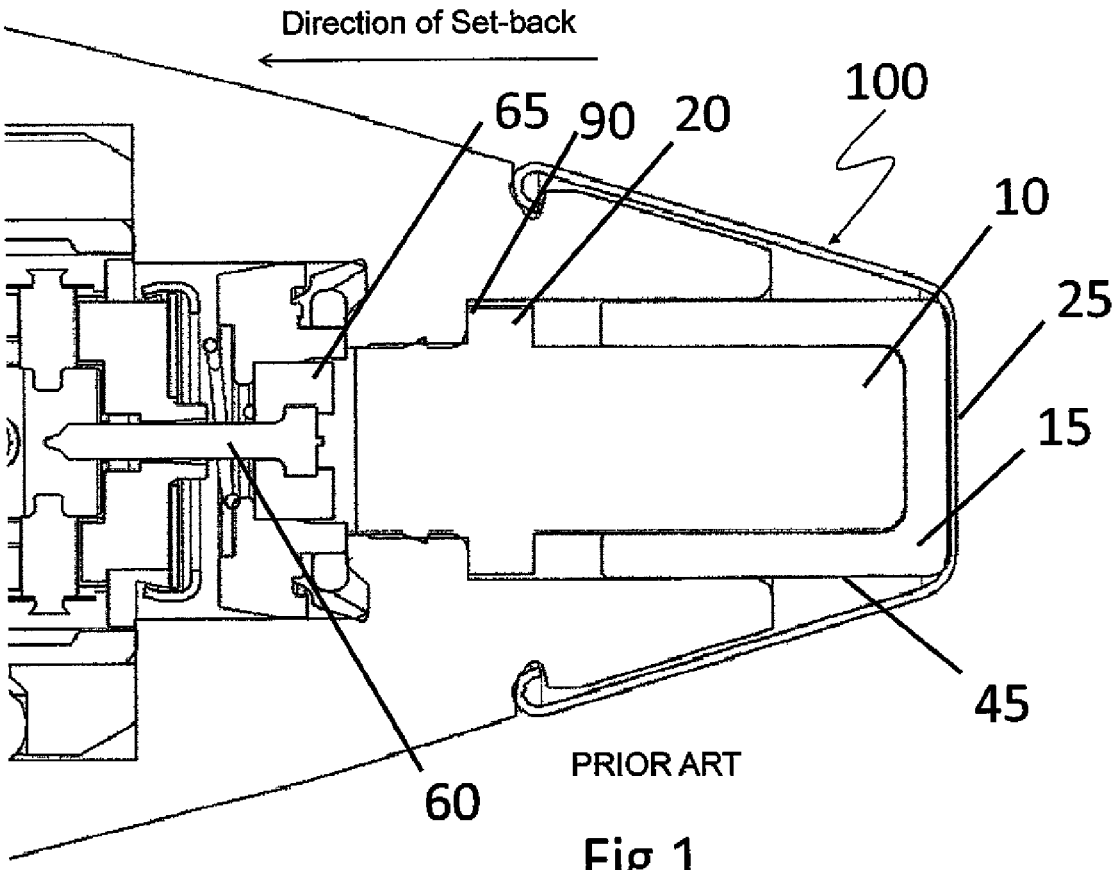
FIG. 1 is a cross-sectional view of the nose portion of an M759, or similar stab upon impact type fuze, of the prior art.

For reference purposes, shown in FIG. 1 is a cross-sectional view of an M759 fuze 100 of the prior art, wherein there is a nylon probe 10 held within an aluminum confinement cup 15, which is disposed in a cylindrical channel 45 located in the center of the fuze's nose. The front of this probe assembly 10 is adjacent to the windscreen 25, which is deployed about the front face of the fuze. The rear of this probe 10 is deployed adjacent to the piston assembly 65, which houses the firing pin, 60. Upon firing of the cartridge, this probe 10 will not respond to the set back force (whose direction rearward within the shell is show by the arrow on FIG. 1), as an integral annular nylon shoulder 20, extending from the lower section thereof abuts a ledge 90 within the aluminum body of the o-give. Upon impact with a hard target, the integral annular nylon shoulder 20 will shear off against the ledge 90; thereby allowing the nylon probe to impact the piston assembly 65 and so drive the firing pin 60 rearward, to begin the detonation chain that will detonate the cartridge.

Figure 2:
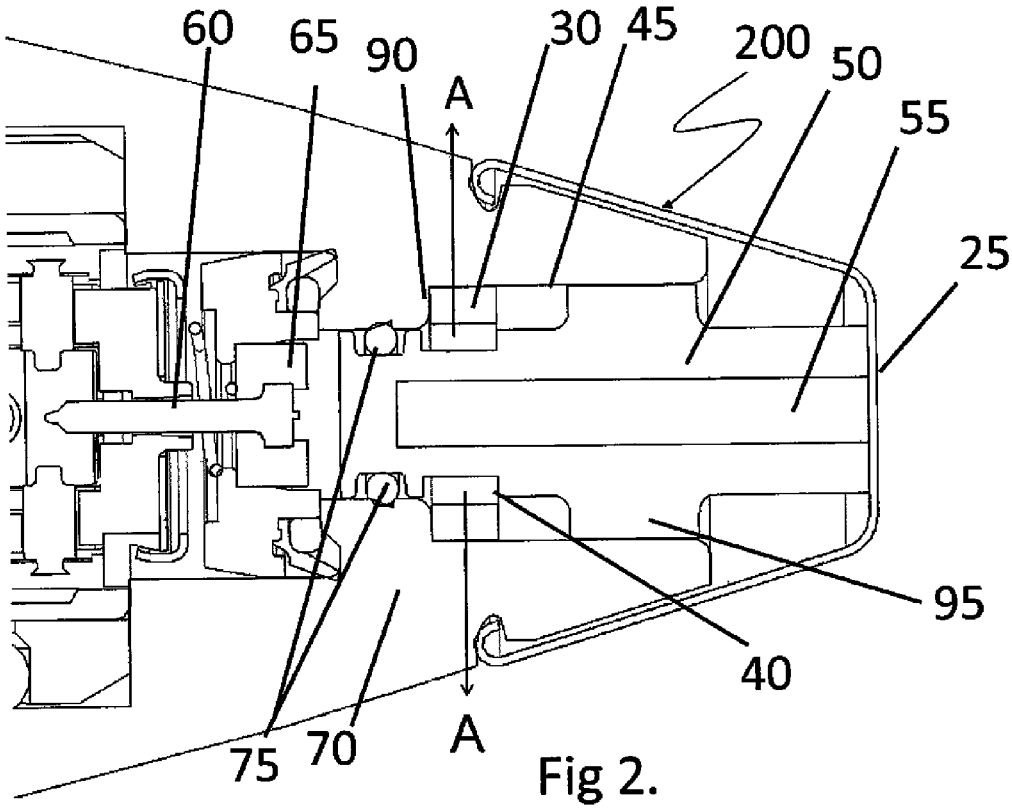
FIG. 2 is a cross-sectional view of the nose portion of a fuze of the present invention, which incorporates therein an anti-set back spin clip of the present invention.

In contrast to the prior art of FIG. 1, shown in FIG. 2, is a cross-sectional view of the front portion of a stab upon impact detonation type fuze 200 of the present invention, wherein a generally cylindrical target sensing probe 50 is disposed in a generally cylindrical channel 45 without the separate, confinement cup being needed about the probe (as required by the prior art). The probe 50 is, as in the prior art, located immediately rearward within the fuze, behind the windscreen 25, which windscreen 25 is also disposed about the nose of the fuze. Further, the probe 50 has a first narrower diameter section adjacent the nose of the fuze, a second enlarged diameter section 95 along the center section thereof, and a third narrower diameter section along the rearward part thereof. The enlarged diameter section 95 lightly contacts and rides against the cylindrical interior of the channel 45; thereby, keeping the probe 50 centered as it moves within the generally cylindrical channel 45. The probe 50 and surrounding generally cylindrical channel are both co-aligned along the longitudinal axis of the cartridge.

The target sensing probe 50 of the fuze 200 of the present invention is also provided with an anti-setback spin clip 30, manufactured of cartridge brass or a similar metal. Initially, i.e. prior to firing of the subject cartridge, the clip 30 which is generally horse shoe shaped, is crimped in a groove 40 toward the rear of the body of the subject probe 50; but extending partially out of the groove 40 (a position not shown in FIG. 2). Adjacent to the portion of the clip 30 extending from the grove 40 and just rearward thereof, within the fuze therefrom, is an annular ledge 90, which ledge 90 is formed by the aluminum o-give 70 extending generally inward toward the center line of the cartridge. The ledge 90 provides support to the portion of the clip extending from the groove 40, such that during firing and setback this overlap will keep the clip 30 and the probe 50 (within which the clip 30 is crimped) from moving rearward within the fuze and thereby prevent the probe 50 from any contact with the piston assembly 65 (and from causing the firing pin 60 to initiate the firing train which detonates the cartridge).

Figure 3:
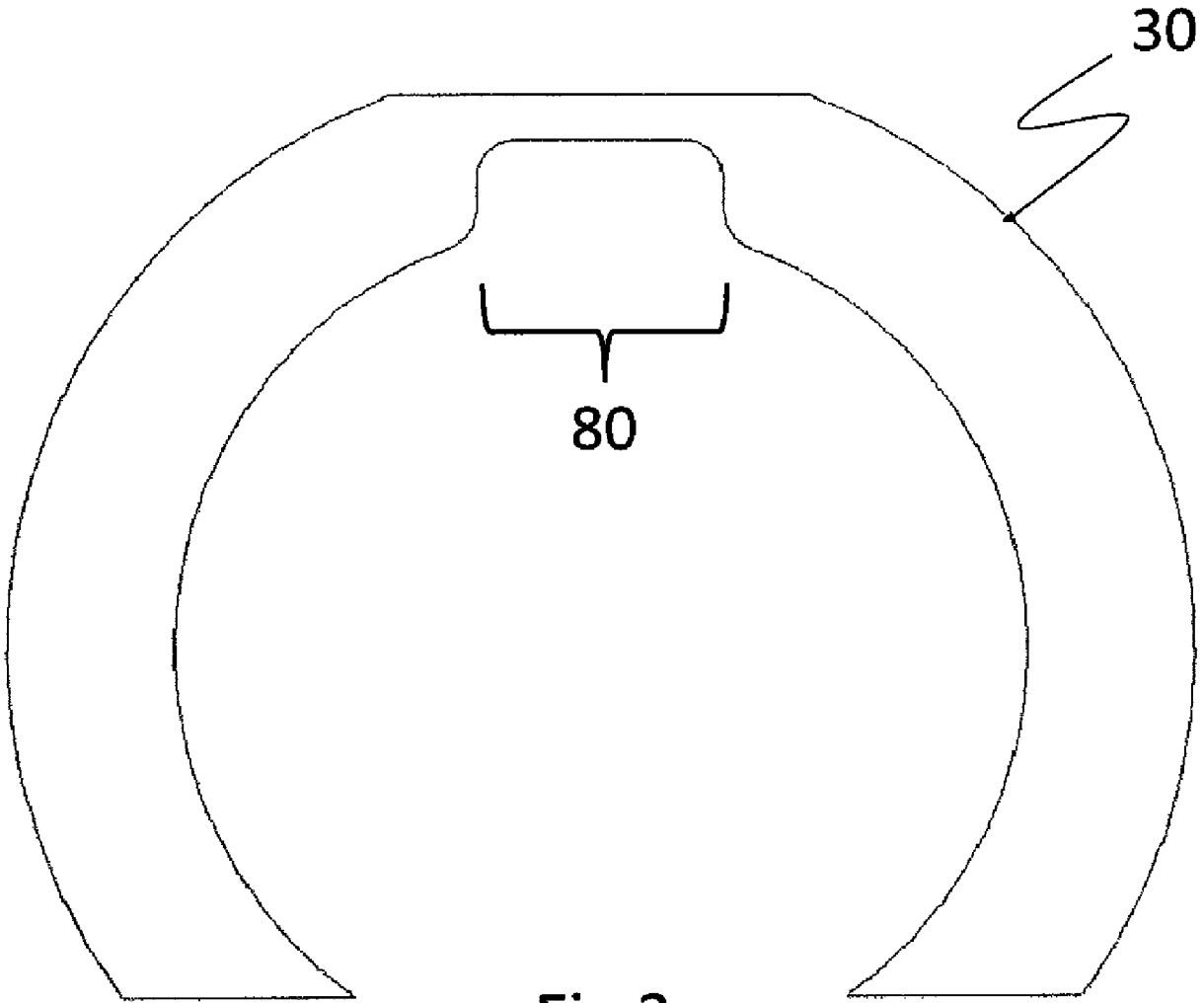
FIG. 3 is an axial view of an anti-set back spin clip of the present invention.

After firing of the cartridge, with the onset of spin and under the centripetal force generated thereby, the anti-setback spin clip 30 will expand away from and out of the grove 40 in the direction of the arrows A, and lodge against the wall of the cylindrical channel 45. As shown in FIG. 3, there is a thinned area 80 in the middle or apex of the anti-setback spin clip 30, such that when the clip 30 expands after firing, under spin, the thinned area 80 (manufactured of cartridge brass or a similar material) will expand in a plastic deformation, therefore the clip 30 will remain expanded. The expanded clip 30, as stated, will open so as to be entirely clear of the groove 40; there being adequate space/clearance between the wall of the cylindrical channel 45 and the probe 50 (again referring to FIG. 2—where the clip 30 is shown in such an expanded fashion, clear of the groove 40). Such that, when the cartridge impacts its target, be it a glancing impact or impact against a soft target, the obstructed forward travel imparted to the target sensing probe 50 will force it rearwards within the fuze (there being now no impediment to such a motion). Therefore the target sensing probe 50 will impact the piston assembly 65; thereby, forcing the firing pin 60 rearward and initiating the firing train of the fuze 200 and subsequently, igniting the secondary explosive in the cartridge and causing cartridge to detonate.

Continuing to refer to FIG. 2, the bore 55 within the probe 50 is blind (i.e. has a closed end) and in addition, an o-ring 75 seal is provided, to seal off the front of the nose section of the fuze, from the section where the piston assembly 65 is located. This seal is required to isolate the closed firing pin assembly from the open nose section (which is open to the atmosphere), to allow for the gas/pressure balancing within the firing pin assembly. Such pressure balancing is an well known effect within such prior art type fuzes, that facilitates the set-back safety mechanism built into such piston assemblies, which mechanism is also used in the present invention; but, is not a part thereof.

Although the invention has been described above in relation to preferred embodiments thereof, it will be understood by those skilled in the art that variations and modifications can be effected in these preferred embodiments without departing from the scope and spirit of the invention as claimed.

What is claimed is:

1. A stab upon impact type fuze mechanism which triggers the firing pin to detonate the cartridge upon direct or glancing impact with a hard, or a soft target thereby, the mechanism comprising:

(a) the fuze having a front end located at the nose thereof and a rear end located at the tail thereof;

(b) the front portion of the fuze extending rearward from the nose thereof being the o-give;

(c) the fuze having a piston assembly therein, comprising the firing pin;

(d) a wind shield disposed about the front end thereof and disposed immediately rearward of said wind shield is a generally cylindrical target sensing probe which is located in a generally cylindrical channel which extends into and through the front portion of the o-give; the target sensing probe extends to, but is spaced away from, the piston assembly of the fuze, which piston assembly is located immediately rearward therefrom;

(e) the target sensing probe and generally cylindrical channel both being disposed about and co-aligned with the longitudinal axis aligned along the center line of the cartridge;

(f) the target sensing probe having a first, narrower diameter section adjacent the front end, a second, enlarged diameter section along the center section thereof, and a third, narrower diameter along the rearward section thereof;

(g) said generally cylindrical channel having an enlarged diameter along its middle section, which corresponds to the diameter of the enlarged diameter section of the target sensing probe, such that the enlarged diameter section of the target sensing probe will be in light contact with that portion of the generally cylindrical channel and thus be guided as it moves relative to the cylindrical channel to maintain alignment with the longitudinal axis;

(h) said generally cylindrical channel having a narrower diameter section located rearward of the enlarged diameter section thereof, which narrower section extends generally perpendicularly inward toward the longitudinal axis of the cartridge, thereby forming a ledge;

(i) an anti-setback spin safety clip having a generally horse shoe shaped axial cross section, the safety clip having an interior inner edge within its open front and an outer edge opposed thereto along its exterior side;

(j) the safety clip being crimped about and extends from a groove about the periphery of the target sensing probe, the inner edge of the open front of the safety clip being seated within said groove;

(k) the portion of the anti-setback clip that extends from the groove is located closely to and co-extensive with the a portion of the ledge that is located immediately to the rearward thereof;

(l) the portion of the anti-setback spin clip which extends from the groove is a flat and the opposed portion of the ledge that is located immediately rearward thereof is correspondingly flattened;

(m) such that, when the cartridge is fired and the target sensing probe is subjected to setback forces, the target sensing probe will be prevented from moving rearward within the fuze, as the extending portion of the anti-setback spin clip will impact against the portion of the ledge located rearward thereto; and (n) such that, when the cartridge approaches its terminal spin velocity, the anti-setback spin clip will be forced open by the centripetal force, such that the outer edge of the anti-setback spin clip will seat against the inner side of the channel;

(o) the central portion of the generally horse shoe shaped anti-setback spin safety clip, between its inner and outer edges, is thinned;

(p) whereby, the thinned portion of the clip will be plastically deformed;

(q) such that, when the cartridge impacts its target, the anti-setback spin clip will remain open and clear of the target sensing probe, such that the target sensing probe will be unimpededly forced rearward by the obstructed forward travel of the cartridge and will hit the piston assembly, and thereby trigger the firing pin to initiate detonation of the cartridge.

2. The stab upon impact type fuze mechanism of claim 1, wherein the anti-setback spin clip is manufactured of cartridge brass.

3. The stab upon impact type fuze mechanism of claim 1, wherein the target sensing probe is manufactured of a metal.

4. The stab upon impact type fuze mechanism of claim 3, wherein the metal of which the target sensing probe is manufactured is aluminum.

5. The stab upon impact type fuze mechanism of claim 1, wherein the target sensing probe is manufactured of a filled polymeric material.

6. The stab upon impact type fuze mechanism of claim 1, wherein the target sensing probe has a cylindrical bore along the longitudinal axis thereof, which bore is open toward the side of the probe facing the front end of the cartridge and closed toward the side of the probe facing the rear of the cartridge.

* * * * *